US006212784B1

(12) United States Patent
Pittman

(10) Patent No.: US 6,212,784 B1
(45) Date of Patent: Apr. 10, 2001

(54) THREE-DIMENSIONAL ROBOTIC SCRIBING SYSTEM

(76) Inventor: Danny R. Pittman, 44339 22nd St. W., Lancaster, CA (US) 93536

( * ) Notice: Subject to any disclaimer, the term of this patent is extended or adjusted under 35 U.S.C. 154(b) by 0 days.

(21) Appl. No.: 09/189,289

(22) Filed: Nov. 10, 1998

Related U.S. Application Data

(60) Provisional application No. 60/064,773, filed on Nov. 10, 1997.

(51) Int. Cl.[7] ..... B43L 13/00

(52) U.S. Cl. ..... 33/18.1; 33/1 M

(58) Field of Search ..... 33/1 M, 18.1, 33/21.1, 23.11, 26, 32.3, 503, 504, 430, 556, 558, 558.01, 558.04, 20.1, 20.2, 21.2, 21.3, 21.4, 23.04, 24.01, 32.1; 702/152, 150, 151

(56) References Cited

U.S. PATENT DOCUMENTS

| | | | | |
|---|---|---|---|---|
| 4,165,523 | * | 8/1979 | Hathaway | 360/77.16 |
| 4,184,261 | * | 1/1980 | Buerner | 33/18.1 |
| 4,306,464 | * | 12/1981 | Mosher | 74/490.08 |
| 4,932,131 | * | 6/1990 | McMurtry et al. | 33/1 M |
| 5,040,306 | * | 8/1991 | McMurtry et al. | 33/556 |
| 5,088,046 | * | 2/1992 | McMurtry | 364/474.03 |
| 5,152,072 | * | 10/1992 | McMurtry | 33/504 |
| 5,222,034 | * | 6/1993 | Shelton et al. | 702/152 |
| 5,323,540 | * | 6/1994 | McMurtry et al. | 33/559 |
| 5,507,212 | * | 4/1996 | Morrison | 83/879 |
| 6,021,574 | * | 2/2000 | Murray, III | 33/18.1 |
| 6,078,876 | * | 6/2000 | Rosemberg et al. | 702/152 |

FOREIGN PATENT DOCUMENTS

| | | | | |
|---|---|---|---|---|
| 2655049 | * | 4/1976 | (DE) | 33/1 M |
| 4232849 | * | 4/1993 | (DE) | 33/501 |
| 965334 | * | 9/1950 | (FR) | 33/1 M |
| 2518739 | * | 6/1983 | (FR) | 33/555 |

OTHER PUBLICATIONS

IBM Technical Disclosure Bulletin, "X–Y Coordinate Transcription System", vol. 7, #10, Mar. 1965.*

IBM Technical Disclosure Bulletin, "Step and Repeat Camera", vol. , #4, Sep. 1964.*

* cited by examiner

*Primary Examiner*—Christopher W. Fulton
*Assistant Examiner*—Maria Fernandez
(74) *Attorney, Agent, or Firm*—Roger A. Marrs

(57) ABSTRACT

A programmable system employs a driver computer control programmed via a personal computer having a keyboard input. The controller sends programmed signals via the keyboard input to a three-dimensional coordinator circuit which generates X, Y and Z drive signals representing left, right and height positions of a scribe which is in alignment with the surface of a workpiece. Positioned between the three-dimensional coordinate circuit and the scribe is an electronic-to-mechanical conversion means in the form of a machine piston which converts the electrical X, Y and Z programmed instructions to a servo and trigger network interfaced with the scribe. An angle position driver directly couples, in parallel, the driver computer control and the three-dimensional coordinating circuit with the servo and trigger network. By programming the instructions into the system, the scribe can follow or coordinate with the workpiece surface whether it is flat, curved or irregular.

1 Claim, 1 Drawing Sheet

THREE-DIMENSIONAL ROBOTIC SCRIBING SYSTEM

Priority claimed based on Ser. No. 60/064,773 filed Nov. 10, 1997.

BACKGROUND OF THE INVENTION

1. Field of the Invention

The present invention relates to the field of measuring apparatus, and more particularly to a novel coordinate measuring equipment employing a programmable position and actuating means for locating a scribe with respect to critically and strategically placing the scribe in a particular angular or in-dash line position with respect to a work surface.

2. Brief Description of the Prior Art

In the past, it has been the conventional practice to scribe layout lines on a work surface for either whole location or for trimming purposes. Sometimes the work surface is of a three-dimensional, volummetric configuration such as a sphere, cube or cone, as well as a flat surface. In either measuring across the work surface or for whole location purposes, a scribe is normally trained across the work surface in accordance with optical viewing equipment in order to obtain accuracy of location and measurement. Sometimes the location is determined by operator eye coordination which is less efficient and inaccurate. When employing electronic positioning equipment, it is not always possible to arrange for angular or special positioning of the scribe so that a variety of work curved surfaces can be accommodated. Also, difficulties have been encountered when using conventional machines which stem largely from the fact that small incremented steps or joggles are difficult if not impossible for conventional measuring machines to achieve accurate measurement. The difficulties are derived from the fact that the small steps are point-to-point measurements and it is difficult to measure or locate specific points on irregular surfaces.

Therefore, a long-standing need has existed to provide a coordinated measuring equipment which is programmable and which is a time-saving process not requiring manual inspection or manual location of scribe points. Such equipment should incorporate the advantages of employing a fully articulated scribe which makes optically measurement or remanufacture possible of component parts so that accuracy of attachment areas in the aerospace and automotive fields are achieved. Thus, assembly time will be increased while adding structural integrity as well as accuracy.

SUMMARY OF THE INVENTION

Accordingly, the novel three-dimensional robotic scribing system of the present invention avoids the above-noted problems by providing a programmable system that employs a driver computer control that is programmed via a personal computer having a keyboard input. The contoller sends programmed signals to a three-dimensional coordinator circuit which generates X, Y and Z drive signals representing left, right and height positions of a scribe which is in alignment with the surface of a workpiece. Between the three-dimensional coordinate circuit and the scribe is an electronic to mechanical conversion means taking the form of a machine piston which converts the electrical X, Y and Z programmed instructions to a servo and trigger network interfaced with the scribe. Also, an angle position driver directly couples, in parallel, the driver computer control and the three-dimensional coordinating circuit with the servo and trigger network. Therefore, by programming the instructions into the system, the scribe can follow or coordinate with the workpiece surface whether it is flat, curved or irregular.

In one form, the scribe itself may include a housing with a reciprocating shaft having a conical pointed end. The shaft is spring-loaded within the housing so as to normally outwardly project from one end of the housing into contact with the workpiece surface. Also, the housing may be clamped by one of several means to the machine ram or piston taking its instructions from the three-dimensional coordinating circuit via the servo and trigger network. Means are employed on the housing, in one version of the scribe, for articulating the scribe shaft into an angular position so as to be more definitely related to the workpiece surface.

Therefore, it is among the primary objects of the present invention to provide a novel coordinated measuring apparatus for use in measurement scribing which eliminates time-consuming manual inspection processes.

Another object of the present invention is to provide a measuring apparatus which is adapted to measure or follow patterns on a work surface whether it is irregular or regular even if the pattern is represented by small steps or joggles or is a continuous linear line or the like whereby accuracy of measurement is increased so as to result in a decrease in assembly time in the aerospace and automotive industries.

Still a further object resides in providing a measuring apparatus which employs a fully articulated scribe for measuring a pattern on a workpiece surface whether the surface is a sphere, a cube, a cone or other irregular surface.

A further object resides in providing a novel scribe in a fully programmable measuring system whereby the scribe may a straight scribe, a heavy duty, manually adjustable scribe by means of an electric trigger, a heavy duty, manually adjustable scribe without trigger or may be a light duty scribe for use on an indexable trigger device.

Also, the present invention resides in providing a variety of mounting means for detachably connecting the scribe to an actuating ram which is programmably operated through computer and converting circuits whereby the means may take the form of a clamp, a squeeze collet, a lock screw and bolt arrangement, a cam lever or the like.

BRIEF DESCRIPTION OF THE DRAWINGS

The features of the present invention which are believed to be novel are set forth with particularity in the appended claims. The present invention, both as to its organization and manner of operation, together with further objects and advantages thereof, may best be understood with reference to the following description, taken in connection with the accompanying drawings in which:

DESCRIPTION OF THE PREFERRED EMBODIMENTS

Figure 1:
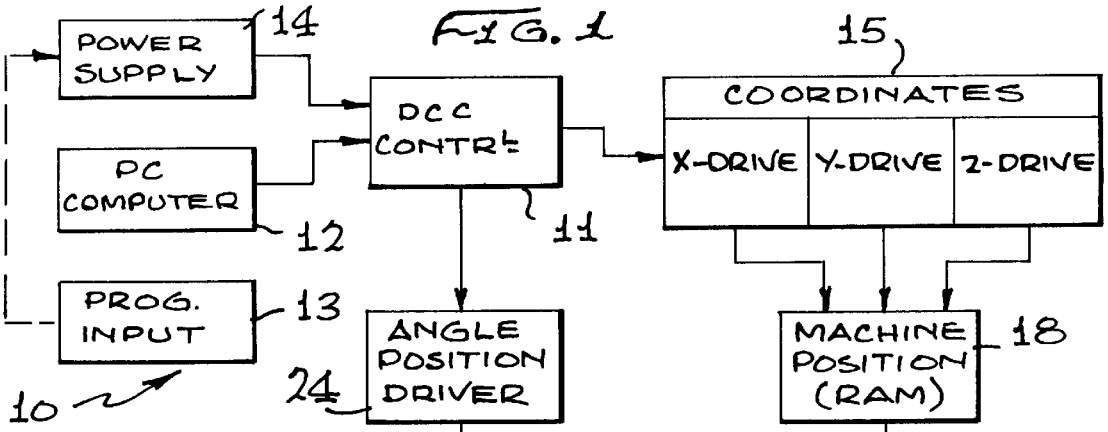
FIG. 1 is a block diagram illustrating the novel system incorporating the three-dimensional robotic scribing device.

Referring to FIG. 1, a three-dimensional robotic scribing system is illustrated in the general direction of arrow 10 which includes a coordinate driver computer controller 11 which is set by a PC computer 12 through a program input such as a keyboard 13. A power supply 14 is employed to supply operating current to the system 10. The pre-programmed coordinate controller 11 receives instructions from the PC and instructs a three-dimensional coordinate circuit 15 as to three-dimensional positions or paths representing X, Y and Z positions. The X and Y positions are indicated on a workpiece 16 having a surface with a pattern or design intended to be measured. The X, Y positions represent right and left movements of a scribe device 17 while the Z position is representative of height. The position coordinate signals from the circuit 15 are received by a mechanical device such as a machine piston or ram 18, such as solenoid operated, which then operates a scribe 20 carried within a housing 21 of the scribe unit 17. The coupling or connection between the machine piston 18 and the scribe unit 17 is indicated in broken lines while an alternate operation of another scribe is indicated in solid lines wherein operation of the scribe is through a trigger and servo 22 to a scribe of a different variation, indicated by numeral 23. Also, it can be seen that for an articulated or angular scribe, an angle position driver 24 is coupled between the coordinate driver controller 11 and the trigger or servo 22.

Thus, depending on the input program from the keyboard 13 through the computer 12 and into the controller 11, instructions are provided for positioning the scribe 20 via the coordinate network 15 and the angle position driver 24 and/or the machine piston 18. It is to be understood that the workpiece 16 includes a surface which may be curved, such as on a sphere, a cone, or an irregular surface as the case may appear.

Figure 2:
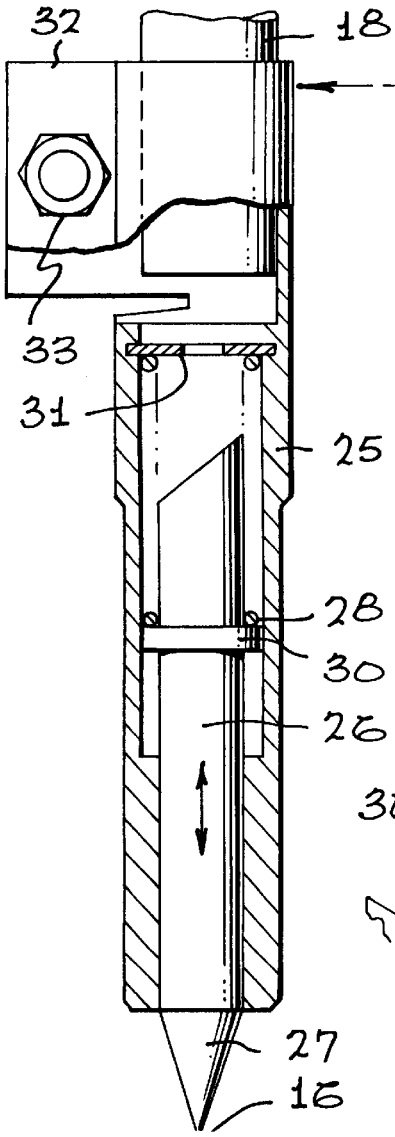
FIG. 2 is an enlarged longitudinal sectional view of one version of a scribe used in the system shown in FIG. 1.

Referring now in detail to FIG. 2, another version of scribe is illustrated in the direction of arrow 23 which includes a housing 25 having a reciprocating shaft as a scribe, indicated by numeral 26. The scribe 26 includes a planted or conical tip 27 that engages the surface of the workpiece 16. The housing 25 includes an open-ended bore occupied by the shaft of the scribe 26. A spring 28 forcibly urges the scribe outward so that the conical tip extends from one end of the housing 25. The resilient means includes a collar 30 having an upper surface against which one end of the expansion spring 28 bears while the opposite end of the expansion spring bears against a washer or shoulder 31 terminating the bore of the housing 25.

It can also be seen that the machine piston 18 which may include a ram is connected to the housing 25 by means of a squeeze collet, a squeeze clamp, a lockscrew and collar arrangement or by a cam lever. As illustrated, a clamp 32 is employed with a tightening or locknut 33. It is manually adjusted to angle, locked and held in position by means of a capscrew 35. The position and means for driving the scribe 26 into the angular position is under the control of the angle position driver 24 when instructed by the program introduced through the computer 20 and the coordinate driver controller 11.

Figure 3:
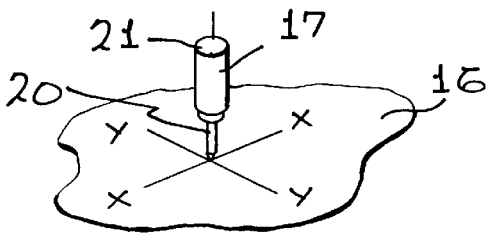
FIG. 3 is a reduced alternate version of a scribe illustrating articulation thereof.
Figure 3:
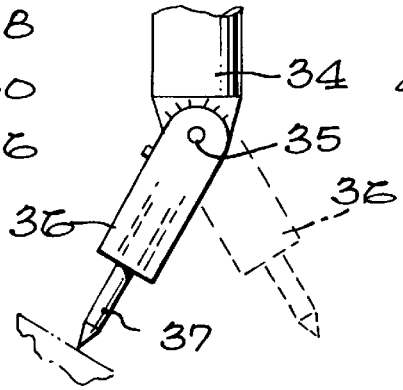

Referring now in detail to FIG. 3, another version of scribe is illustrated wherein the end of a housing 34 terminates in a pivot connection 35 with a scribe holder 36 from which the scribe 37 outwardly projects to engage the workpiece. By means of the capscrew 35, the scribe 37 may be placed in angular positions, as represented by the solid line position or a dotted line position.

Figure 4:
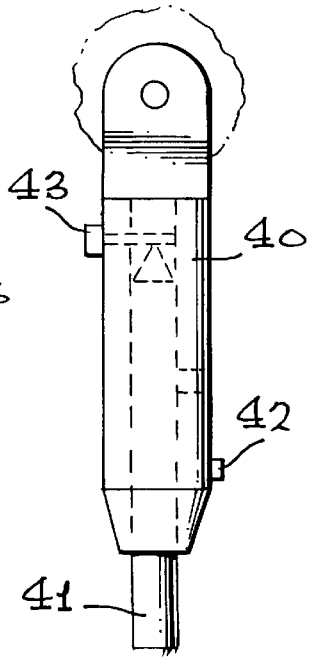
FIG. 4 is another version of the scribe illustrating an alternate mounting means.

Referring now in detail to FIG. 4, still another version of the scribe is illustrated in which a housing 40 carries a scribe 41 having a pointed tip which extends beyond one end of the housing. With reciprocating motion, trigger switch 42 allows measuring or qualifying switch 43 to turn off switch 42 when it is not desired to send a trigger signal.

It can be seen that any one of the alternate scribe versions can be used with the positioning system 10, as previously described. Therefore, when it is intended to measure a pattern or design on the surface of workpiece 16 or to coordinate a variety of critical locations thereon, the setting for the scribe is introduced via the input program, such as keyboard 13 where the computer 12 then instructs the controller 11 so that the coordinate network 15 provides proper instructions and locating instructions to the machine piston 18, such as solenoid operated, for moving the scribe 20. Alternately, if an angular position is needed as shown by the scribe in FIG. 3, the instructions from the controller are augmented by the angle position driver 24 and through the trigger and servo circuit 22 adjust the scribe 27 similar to the depiction of 37, as shown in FIG. 3 which is manually adjusted. FIGS. 2–4 inclusive illustrate a variety of scribe constructions and mounting means with respect to the housing which are available for the operator.

While particular embodiments of the present invention have been shown and described, it will be obvious to those skilled in the art that changes and modifications may be made without departing from this invention in its broader aspects and, therefore, the aim in the appended claims is to cover all such changes and modifications as fall within the true spirit and scope of this invention.

What is claimed is:

1. A three dimensional robotic scribing apparatus comprising:

a driver computer control having an angle position driver;

a personal computer having a keyboard input and coupled to said driver computer control for introducing programming instructions to said driver computer control;

a three-dimensional coordinator circuit connected to said driver computer control and responsive to programming instructions to generate X, Y and Z drive signals;

a scribe positionable about a work surface, said angle position driver being connected between said driver computer control and said scribe;

an electro-mechanical device connected between said three-dimensional coordinator circuit and said scribe in parallel relationship with respect to said angle position driver with said scribe responsive to follow said programming instructions regarding X, Y, and Z drive signals for directional control with respect to said work surface, wherein said electro-mechanical device is a solenoid operated reciprocating piston within a housing;

a trigger and servo network connected between said angle position driver and said scribe for angularly positioning said scribe with respect to said work surface; and a program input connected to said personal computer in addition to said keyboard for introducing said X, Y, and Z drive signals as programming data therein for application to said three-dimensional coordinator circuit via said driver computer control.

* * * * *